US009779894B2

(12) United States Patent
Cohen et al.

(10) Patent No.: US 9,779,894 B2
(45) Date of Patent: Oct. 3, 2017

(54) BUTTON FEATURES OF AN ELECTRONIC DEVICE

(71) Applicant: Apple Inc., Cupertino, CA (US)

(72) Inventors: Sawyer I. Cohen, Sunnyvale, CA (US); Tyler B. Cater, Cupertino, CA (US); Marwan Rammah, Cupertino, CA (US); Yaocheng Zhang, Cupertino, CA (US); Edward S. Huo, San Jose, CA (US); Dhaval N. Shah, Fremont, CA (US); Scott A. Myers, Saratoga, CA (US); Vivek Katiyar, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 81 days.

(21) Appl. No.: 14/553,985

(22) Filed: Nov. 25, 2014

(65) Prior Publication Data

US 2016/0071664 A1 Mar. 10, 2016

Related U.S. Application Data

(63) Continuation of application No. PCT/US2014/067452, filed on Nov. 25, 2014.
(Continued)

(51) Int. Cl.
*H01H 3/12* (2006.01)
*H01H 13/14* (2006.01)
(Continued)

(52) U.S. Cl.
CPC ..... *H01H 13/705* (2013.01); *H01H 13/52* (2013.01); *H01H 2221/062* (2013.01); *H01H 2221/064* (2013.01); *H01H 2221/08* (2013.01)

(58) Field of Classification Search
CPC H01H 1/46; H01H 3/12; H01H 13/00; H01H 13/14; H01H 13/70; H01H 9/02;
(Continued)

(56) References Cited

U.S. PATENT DOCUMENTS 2,954,452 A * 9/1960 Neumann ..... H01H 9/04 200/302.3
3,673,369 A * 6/1972 Weaver ..... H01H 35/346 200/83 B
(Continued)

FOREIGN PATENT DOCUMENTS

JP 2007165317 6/2007

OTHER PUBLICATIONS

PCT Application No. PCT/US2014/067452—International Search Report and Written Opinion dated Jun. 17, 2015.

*Primary Examiner* — Anthony R. Jimenez
(74) *Attorney, Agent, or Firm* — Downey Brand LLP

(57) ABSTRACT

Systems and methods for forming button assemblies for electronic devices are disclosed. According to some embodiments, the button assemblies include one or more sound improvement features to improve the sound that the button assemblies make when pressed by users of the electronic devices. According to some embodiments, the button assemblies include shims that provide proper alignment of the various components of the button assemblies and to accommodate any tolerance stack up of the various components of the button assemblies. The shims can include alignment features to prevent the shims from shifting within the button assemblies. According to some embodiments, thicknesses of the shims are customized to accommodate varying tolerance stack ups of the components of the button assemblies. In some embodiments, the button assemblies include a combination of sound improvement features and shims.

20 Claims, 18 Drawing Sheets

Related U.S. Application Data

(60) Provisional application No. 62/046,822, filed on Sep. 5, 2014.

(51) Int. Cl.
*H01H 13/705* (2006.01)
*H01H 13/52* (2006.01)

(58) Field of Classification Search
CPC ..... H01H 9/22; H01H 13/04; H01H 13/10; H01H 13/50; H01H 2003/12; H01H 2009/02; H01H 2009/0214; H01H 2009/0278; H01H 2009/0257; H01H 2013/00; H01H 2013/50; H01H 2013/04; H01H 2221/042; H01H 2221/044; H01H 2221/084; H01H 3/00; H01H 3/50; H01H 2021/00; H01H 2021/18; H01H 2021/22; H01H 2021/24; H01H 2201/01; H01H 2221/00; H01H 2221/052; H01H 2221/05; H01H 2221/09; H01H 2223/00; H01H 2231/02; H01H 2233/00; H01H 2233/012; H01H 2233/032; H01H 2233/052; H01H 2233/072; H01H 2233/092; H01H 2237/006; H01H 2237/008; H01H 2239/02; H01H 13/705; H01H 13/52; H01H 2221/062; H01H 2221/064; H01H 2221/08; H02H 3/00; H02H 3/50; H02H 2021/00; H02H 2021/18; H02H 2021/22; H02H 2021/24; H02H 2201/01; H02H 2221/00; H02H 2221/052; H02H 2221/05; H02H 2221/09; H02H 2223/00; H02H 2231/02; H02H 2233/00; H02H 2233/012; H02H 2233/032; H02H 2233/052; H02H 2233/072; H02H 2233/092; H02H 2237/006; H02H 2237/008; H02H 2239/02
USPC ..... 200/5 R, 5 A, 510, 511, 520–522, 200/537–539, 548, 329, 341, 343, 345, 200/17 R
See application file for complete search history.

(56) References Cited

U.S. PATENT DOCUMENTS

| | | | | |
|---|---|---|---|---|
| 3,773,997 | A * | 11/1973 | Evans | B41J 5/12 200/330 |
| 5,028,752 | A * | 7/1991 | Sanai | H01H 13/52 200/341 |
| 5,689,095 | A * | 11/1997 | Kawase | H01H 25/008 200/5 R |
| 9,472,360 | B2 * | 10/2016 | Ely | H01H 13/705 |
| 2005/0056531 | A1 * | 3/2005 | Yu | H01H 13/83 200/310 |
| 2007/0140614 | A1 | 6/2007 | Kim et al. | |
| 2010/0003450 | A1 * | 1/2010 | Meyer | B60R 13/0206 428/99 |
| 2013/0118876 | A1 | 5/2013 | Strittmatter | |
| 2014/0069782 | A1 | 3/2014 | Shedletsky et al. | |
| 2014/0069789 | A1 | 3/2014 | Shah et al. | |
| 2014/0112371 | A1 | 4/2014 | Yang et al. | |

* cited by examiner

BUTTON FEATURES OF AN ELECTRONIC DEVICE

CROSS REFERENCE TO RELATED APPLICATIONS

This application is a continuation of International Application PCT/US14/67452, with an international filing date of Nov. 25, 2014, entitled "Button Features Of An Electronic Device", and claims priority under 35 U.S.C. 119(e) to U.S. Provisional Patent Application No. 62/046,822, filed Sep. 5, 2014, entitled "Button Features Of An Electronic Device", each of which is incorporated herein by reference in its entirety.

FIELD

The present disclosure relates generally to devices, assemblies and methods related to button assemblies of electronic devices. More specifically, the present embodiments relate to providing a robust button assembly that has an aesthetically appealing feel and sound when actuated.

BACKGROUND

Modern electronic devices generally have a number of user interfaces such that users can interact with the internal components of the electric devices. Examples of such user interfaces include touch screens, keypads, microphones, and buttons. Buttons are typically made of an assembly of multiple mechanical pieces that work together when a user presses on the button, causing one or more switches to actuate. These mechanical pieces work in intricate concert with each other to reliably actuate a switch when a user simply presses on a button. For consumer electronic devices such as portable phones, it is important that all the mechanical features of the button assemblies work together robustly in order to withstand the numerous press events from a user. Portable electronic devices can also undergo numerous drop events. Therefore, the button assemblies must be designed to be robust enough to withstand such drop events and prevent false press events.

In addition, with the advent of smaller electronic devices it is important that the button assemblies take as little room within electronic devices in order to leave room for other components of the electronic devices. Furthermore, consumers demand that the button assemblies have a consistent and good "feel" when a button is pressed. That is, the button assembly should not feel loose or have play when a user presses a button. Therefore, what are needed are better button assemblies and methods for forming button assemblies to meet the complex demands of modern electronic devices.

SUMMARY

This paper describes various embodiments that relate to button assemblies of electronic devices.

According to one embodiment, a button assembly for an electronic device is described. The button assembly includes a bracket configured to support a switch module and is configured to be positioned within an opening of a housing of the electronic device. The bracket including a trim with a surface that nears an impact surface of the housing when the switch module is pressed. The button assembly also includes a dampener positioned between the surface of the trim and the impact surface of the housing such that the surface of the trim is prevented from directly contacting the impact surface of the housing when the switch module is pressed. The dampener is made of a sufficiently compliant material to reduce a noise associated with the surface of the trim contacting the impact surface of the housing.

According to another embodiment, a button assembly for an electronic device is described. The button assembly includes a switch configured to provide an electrical connection for the electronic device. The button assembly also includes a bracket configured to support the switch with respect to a housing of the electronic device, the bracket including a recess. The button assembly additionally includes a shim positioned between the bracket and the switch. The shim has an alignment feature that protrudes from a base of the shim. The alignment feature is positioned within the recess of the bracket so as to prevent shifting of the shim with respect to the bracket and the switch during operation of the button assembly.

According to a further embodiment, a method of forming a customized shim of a button assembly for an electronic device to give the button assembly a predetermined feel is described. The button assembly includes a switch, a button and a bracket. The method includes measuring a number of dimensions of the button assembly. The measuring includes determining a dimension of the switch while a predetermined preload force is applied to the switch. The predetermined preload force is associated with an amount of depression of button assembly when pressed by a user of the button assembly. The method further includes forming the shim such that a thickness of the shim is chosen based on the plurality of dimensions.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings in which.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

Described herein are button assemblies and methods for manufacturing button assemblies as part of electronic devices. According to some embodiments, the button assemblies include one or more sound improvement features to improve the sound that the button assemblies make when pressed by a user. According to other embodiments, the button assemblies include one or more shims that provide proper alignment of the various components of the button assemblies and/or to accommodate any tolerance stack up of the various components of the button assemblies. According to some embodiments, the button assemblies include a combination of sound improvement features and shims.

The methods described herein are well suited for providing robust and aesthetically appealing button assemblies for consumer electronic products, such as those manufactured by Apple Inc., based in Cupertino, Calif. In particular embodiments, the methods are used to form button assemblies for exterior portions of computers, portable electronic devices and/or accessories for electronic devices.

These and other embodiments are discussed below with reference to FIGS. 1-13; however, those skilled in the art will readily appreciate that the detailed description given herein with respect to these figures is for explanatory purposes only and should not be construed as limiting.

Figure 1A:
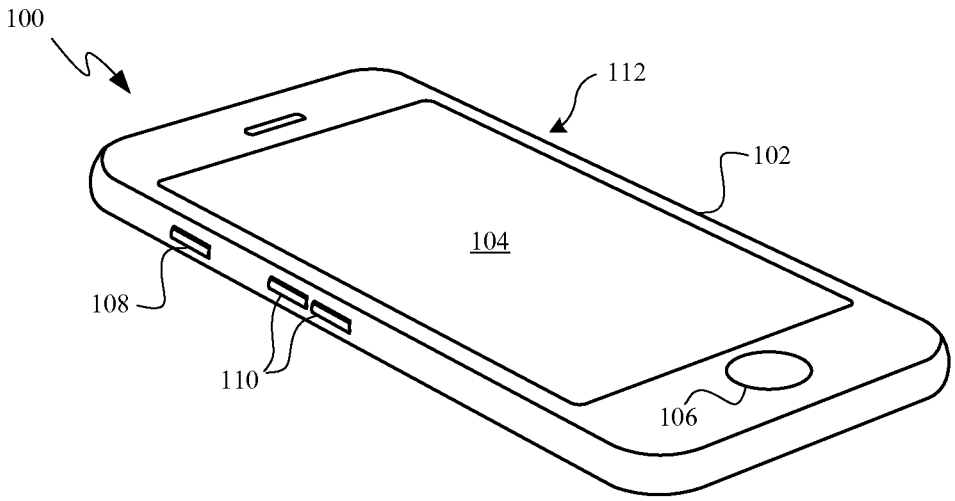
FIGS. 1A and 1B show a perspective view and front view of an electronic device, in accordance with some embodiments.
Figure 1B:
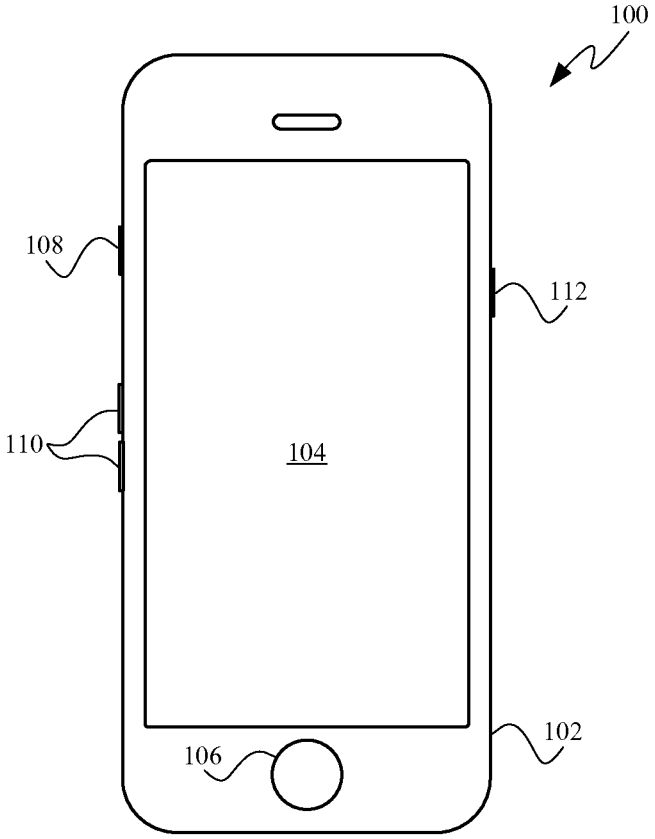

FIGS. 1A and 1B show a perspective view and front view, respectively, of an electronic device 100 having one or more button assemblies in accordance with some embodiments. Electronic device 100 includes housing 102 that is configured to house multiple internal electronic components. In some embodiments, electronic device 100 is a portable phone capable of providing telephonic communication for a user of electronic device 100. In some embodiments, electronic device 100 includes one or more wireless communication antenna(s) within housing 102 for providing wireless communication to and/or from electronic device 100. Display 104 is configured to display output from electronic device 100 to a user. In some embodiments, display 104 includes a touch screen assembly configured to accept touch input from a user.

Electronic device 100 can include a menu button or home button 106, power button 112, mute button 108, and volume buttons 110. In some embodiments, the exterior surface of display 104 corresponds to a glass or plastic cover that covers all or a majority of a front side of electronic device 100. In this way, home button 106 can be positioned within an opening of the glass or plastic cover. In some embodiments, portions of the glass or plastic cover are transparent or translucent to allow viewing of an underlying display assembly. Power button 112, mute button 108, and volume buttons 110 can be positioned within side portions of electronic device 100. In some embodiments, these side portions of electronic device 100 are made of a metal, plastic and/or ceramic material.

Although embodiments herein make reference to electronic device 100, which can be in the form of a mobile phone, this is for illustrative purposes only and it should be appreciated that the button assemblies provided herein can be used in any suitable electronic device such as a tablet computing device, a laptop computing device, a user interface device, a media player, a wearable computing device, and/or any suitable electronic device having one or more button assemblies.

As described above, some embodiments described herein involve forming sound improvement features in the button assemblies in order to improve the sound that the button assemblies make when pressed by a user. These embodiments are described in detail below with respect to FIGS. 2-9. In some embodiments, the button assemblies include one or more shims that can be used to align various components of the button assemblies. The shims can have alignment features to prevent shifting of the shims. These embodiments are described in detail below with respect to FIGS. 10 and 11. In some embodiments, methods for providing customized shims to accommodate varying tolerance stack ups of the components of the button assemblies are described. These embodiments are described in detail below with respect to FIGS. 12 and 13. Note that one or more of the sound improvement features and shim features described below can be combined within a single button assembly.

Figure 2A:
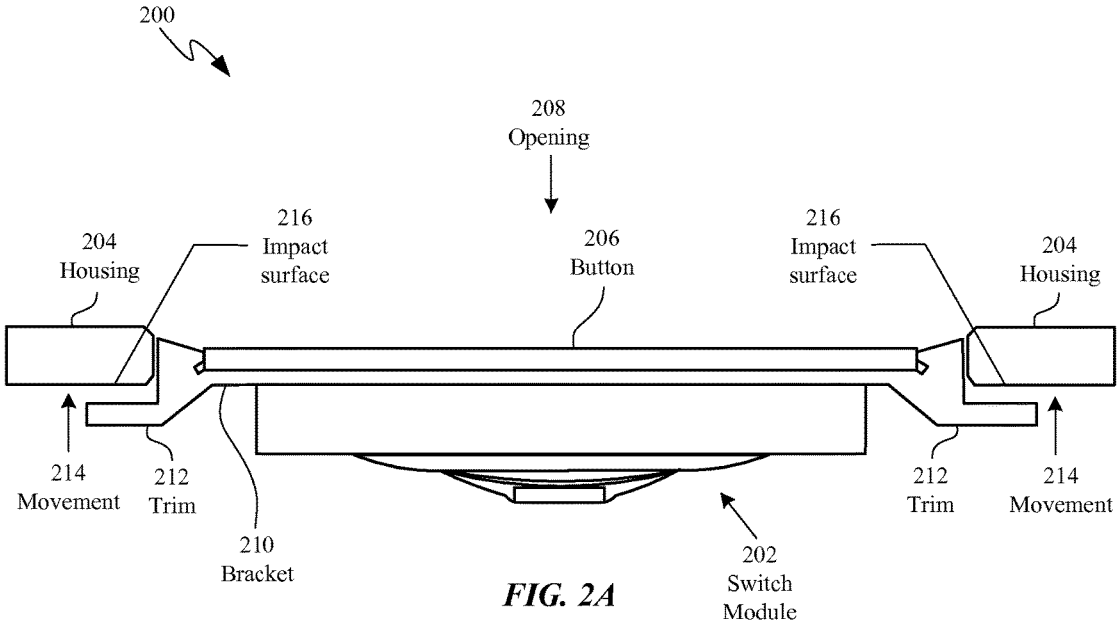
FIGS. 2A and 2B shows section views of button assemblies, in accordance with some embodiments.
Figure 2B:
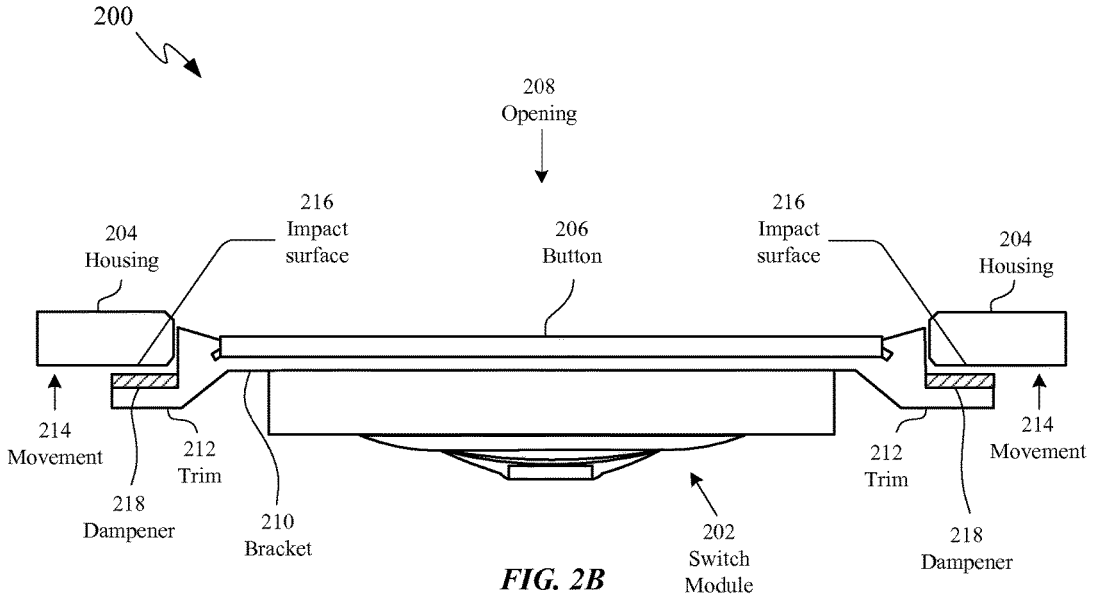

FIGS. 2A and 2B show section views a button assembly 200 in accordance with described embodiments. In some embodiments, button assembly 200 corresponds to a home button, such as home button 106 described above with reference to in FIGS. 1A and 1B. It should be understood, however, that the noise dampening features described below with reference to FIGS. 2A and 2B can be implemented with any suitable button assembly and it not limited to a home button as shown in FIGS. 1A and 1B.

FIG. 2A shows button assembly 200, which includes switch module 202 assembled within an opening 208 of housing 204. Housing 204 can correspond to an exterior surface of the electronic device. In some embodiments, housing 204 corresponds to a cover, such as a transparent glass or plastic cover, as part of a display portion of an electronic device. Switch module 202 includes can include a stack up of different components that assure proper functionality of button assembly 200. For example, switch module 202 includes a switch such that when a user presses button 206, the switch is activated. In some embodiments, switch module 202 is designed to give a user a distinctive "click" feel when button 206 is pressed.

Bracket 210 supports switch module 202 within opening 208 and is coupled to housing 204. Bracket 210 includes trim 212 that define a perimeter of bracket 210. When button 206 is pressed, trim 212 of bracket 210 moves away from impact surface 216. When button 206 is released, trim 212 moves back in direction 214 toward housing 204. As a result, trim 212 contacts housing 204 at impact surface 216. In some cases, the impact of trim 212 to impact surface 216 can cause an audible sound for a user of the device. The sound will depend on a number of factors, including the material of trim 212 and housing 204. In a particular embodiment, trim 212 is made of a metal material, such as stainless steel or an aluminum alloy, and housing 204 is made of a glass material, resulting in a high-pitched tinging sound. In some cases, this high-pitched tinging sound can be undesirable.

In order to reduce the amount of audible sound of button assembly 200, such as a high-pitched tinging sound, one or more noise dampening features can be implemented. FIG. 2B shows button assembly 200 after noise dampener 218 is implemented in accordance with described embodiments. Dampener 218 is positioned between trim 212 of bracket 210 and impact surface 216 of housing 204. Dampener 218 can be made of a compliant material such that when trim 212 moves in direction 214 toward housing 204, dampener 218 reduces or eliminates noise associated with trim 212 contacting impact surface 216. In some cases, this can provide a more pleasing sound to a user when button 206 is pressed. In some embodiments, dampener 218 is made of a plastic, silicone and/or rubber material. In some embodiments, dampener 218 is coupled to trim 212. In other embodiments, dampener 218 is coupled to impact surface 216 of housing 204. In other embodiments, multiple dampeners 218 are coupled to both trim 212 and impact surface 216. Dampener 218 can be adhered onto trim 212 and/or impact surface 216 using any suitable mechanism, including molding or use of an adhesive.

Figure 3A:
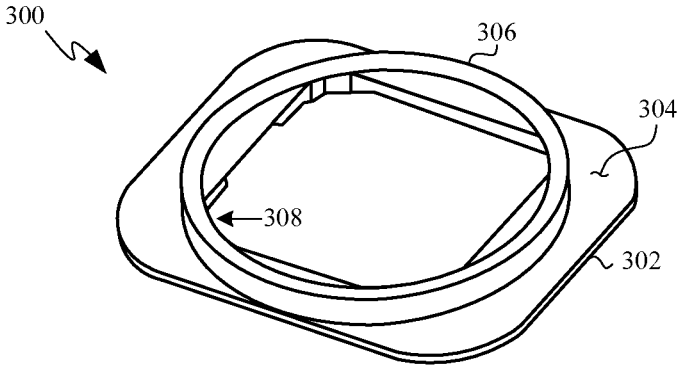
FIGS. 3A-3C show perspective views of different brackets as part of button assemblies, in accordance with some embodiments.
Figure 3B:
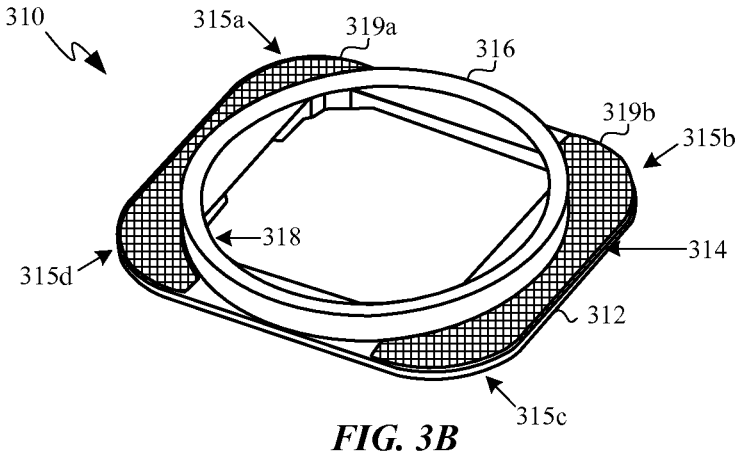
Figure 3C:
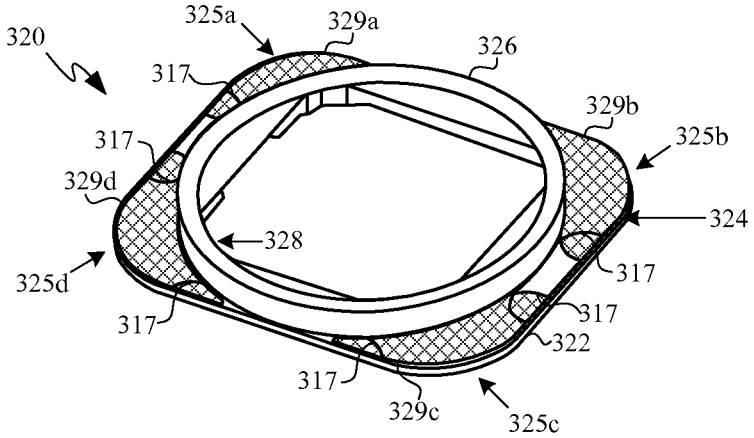

FIGS. 3A-3C show perspective views of different brackets 300, 310 and 320, respectively, in accordance with described embodiments. Note that the shapes of brackets 300, 310 and 320 can vary depending on application requirement and are not limited to having the rounded rectangular perimeter shown in FIGS. 3A-3C. For example, the brackets can have a round, elliptical, square, triangular, or irregular shaped perimeter. Brackets 300, 310 and 320 can each be configured to support a switch module when a user applies a pressing force to the switch module. As such, brackets 300, 310 and 320 can each be made of a sufficiently rigid material for withstanding such pressing force without too much give, such as a metal material like stainless steel or rigid aluminum alloy.

FIG. 3A shows bracket 300, which includes trim 302 that defines a perimeter of bracket 300. Trim 302 can be also referred to as a lip or flange of bracket 300. Bracket 300 includes bezel 306 that protrudes above surface 304 of trim 302 and that includes opening 308 configured to accommodate a switch module or a portion of a switch module. Bezel 306 and opening 308 can have any suitable shape and are not limited to the round shapes shown in FIG. 3A. Surface 304 of trim 302 is uncovered and can contact a housing portion, such as impact surface 216 of housing 204 if impact surface 216 is not covered with a dampener. As such, a button assembly having bracket 300 can provide an audible noise when a user presses on the button assembly.

FIG. 3B shows bracket 310, which has similar features as bracket 300. In particular, bracket 310 includes trim 312 and bezel 316, which includes opening 318 for accommodating a switch module. Bracket 310 additionally includes coverlay 319 that covers at least a portion of surface 314 of trim 312. As shown in FIG. 3B, coverlay 319 can be formed in two sections 319*a* and 319*b*, each covering opposing sides of trim 312. It should be noted that coverlay 319 can have any suitable number of sections. For example, coverlay can be formed in four sections that cover each corner 315*a*, 315*b*, 315*c* and 315*d* of trim 312. In one embodiment, coverlay 319 is a single piece that covers substantially all of surface 314. Coverlay 319 acts as a noise dampening feature that is positioned between trim 312 and a corresponding impact surface of a housing to dampen the noise associated with the trim 312 coming in contact with the impact surface of the housing.

Coverlay 319 can be made of any suitable material including plastic, silicone, rubber, fabric, or combination thereof, and can be coupled to surface 314 using any suitable method. In some embodiments, coverlay 319 is made of a material that is flexible, capable of remaining flat when adhered onto surface 314, and remains chemically stable when exposed to thermal processes. In a particular embodiment, coverlay 319 is made of a polyimide material that is adhered onto surface 314 using an epoxy adhesive. In some embodiments, coverlay 319 is adhered onto surface 314 using a vacuum lamination operation to assure that coverlay 319 is conformally and securely applied to surface 314. Examples of suitable methods for manufacturing coverlay 319 and assembling coverlay 319 onto bracket 310 are described in detail below with respect to FIGS. 4A and 4B.

FIG. 3C shows bracket 320, which has similar features as bracket 300. In particular, bracket 320 includes trim 322 and bezel 326, which includes opening 328 for accommodating a switch module. Bracket 320 additionally includes overmold 329 that covers at least a portion of surface 324 of trim 322. As shown in FIG. 3C, overmold 329 can be formed in four sections 329*a*, 329*b*, 329*c* and 329*d*, each covering corners 325*a*, 325*b*, 325*c* and 325*d* of trim 322, respectively. However, overmold 329 can have any suitable number of sections. In one embodiment, overmold 329 is a single piece that covers substantially all of surface 324. Like coverlay 319, overmold 329 can act as a noise dampening feature that is positioned between trim 322 and a corresponding impact surface of a housing to dampen the noise associated with the trim 322 coming in contact with the impact surface of the housing.

Overmold 329 can be made of any suitable overmold material, including plastic materials. In some embodiments, overmold 329 is made of polyether ether ketone (PEEK), polyphenylsulfone (PPSU), a combination of PEEK/PPSU, or polyphthalamide (PPA). In some embodiments, overmold 329 is formed of a plastic material that includes a stiffening agent, such as glass filler. In a particular embodiment, overmold 329 is made of a PEEK/PPSU mix with about 30% glass filler. In another particular embodiment, overmold 329 is made of a PPA material with glass filler. The choice of material will depend on application requirements.

The shape of overmold 329 can be accomplished using any suitable method, including an injection molding process. During the injection molding process, overmold 329 is deposited onto surface 324 in molten form and allowed to harden. In some embodiments, overmold 329 is shaped by injecting the molten material in a mold with a cavity that has a shape that gives overmold 329 a desired shape. In other embodiments, overmold 329 is shape after hardened onto surface 324. In some embodiments, one or more engagement features 317 are formed on surface 324 for overmold 329 to engage with and secure overmold 329 to trim 322. Overmold can be made of any suitable material including plastic, silicone, rubber, fabric, or combination thereof. Examples of suitable methods for manufacturing overmold 329 and assembling overmold 329 onto bracket 320 are described in detail below with respect to FIGS. 5-7.

Figure 4A:
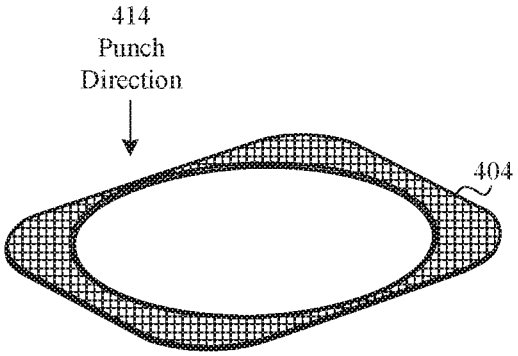
FIGS. 4A and 4B show perspective views of a bracket being assembled with a noise dampening coverlay, in accordance with some embodiments.
Figure 4B:
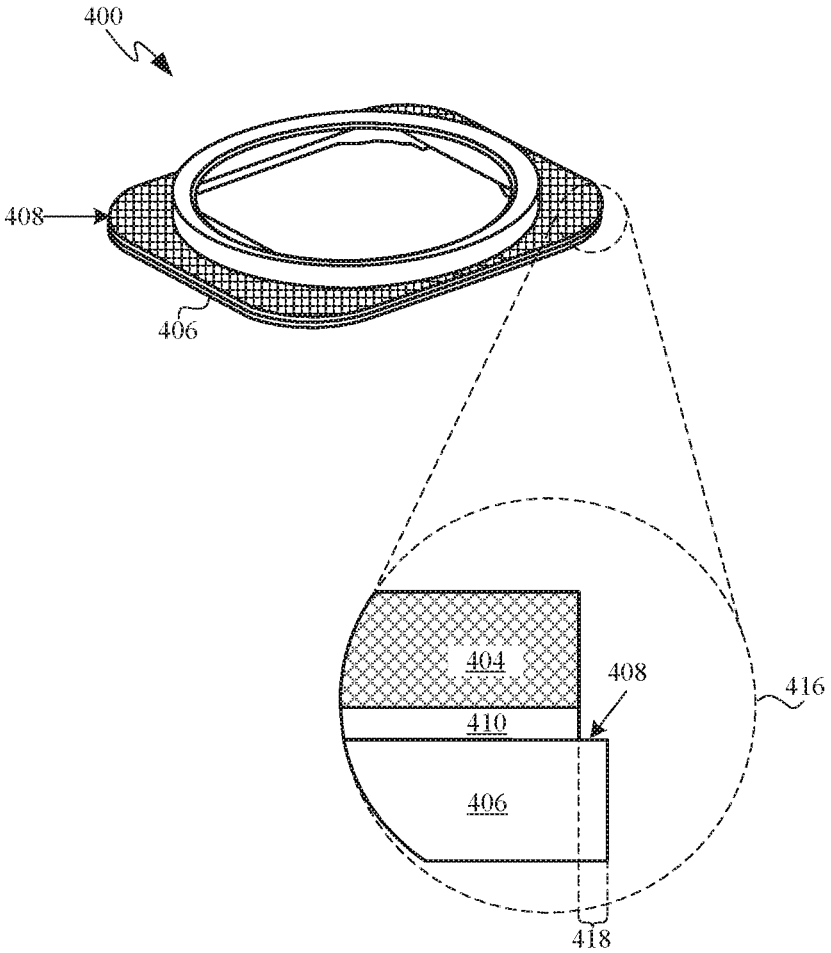

FIGS. 4A and 4B show perspective views of bracket 400 being assembled with noise dampening coverlay 404 in accordance with some embodiments. At FIG. 4A, coverlay 404 is shaped to match the shape of trim 406. In some embodiments, the thickness of coverlay 404 is selected to match trim 406 dimensions of binned brackets 400 having a defined trim 406 thickness in order to achieve tight tolerances in the final button assembly. In some embodiments, the shape of coverlay 404 is achieved using a punching process where coverlay 404 is cut with a punching tool in punch direction 414 such that any burrs that may form do not stick upwards to create a non-flat datum surface.

At FIG. 4B, coverlay 404 is adhered onto surface 408 of trim 406 using adhesive 410. If coverlay 404 is formed using a punch process, coverlay 404 is oriented such that any burrs formed during the punch process are positioned proximate surface 408. In some embodiments, a vacuum lamination process is used in order to assure conformal adherence of coverlay 404 to surface 408. As shown in inset 416, coverlay 404 can be cut to be offset a distance 418 from an edge of trim 406 to assure that there is no overhang of coverlay 404.

Figure 5A:
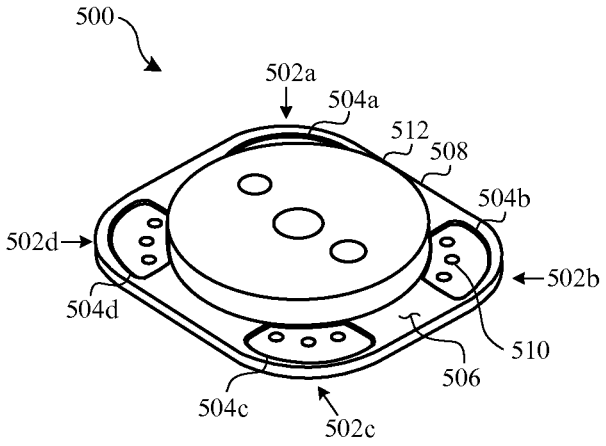
FIGS. 5A-5C and 6A-6C show perspective views of brackets being assembled with noise dampening overmolds using two different manufacturing processes, in accordance with some embodiments.
Figure 5B:
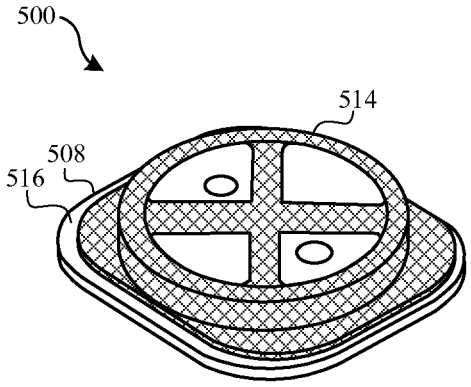
Figure 5C:
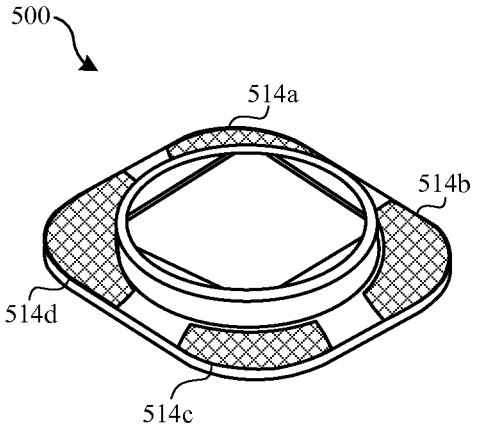
Figure 6A:
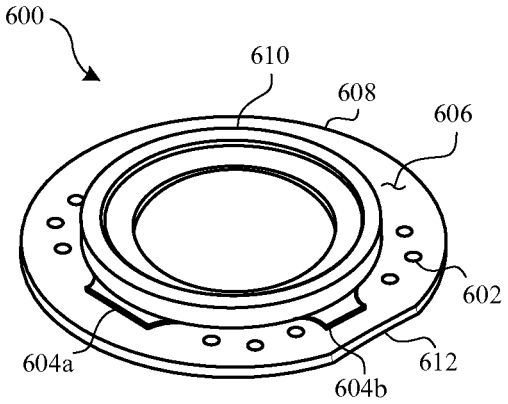
Figure 6B:
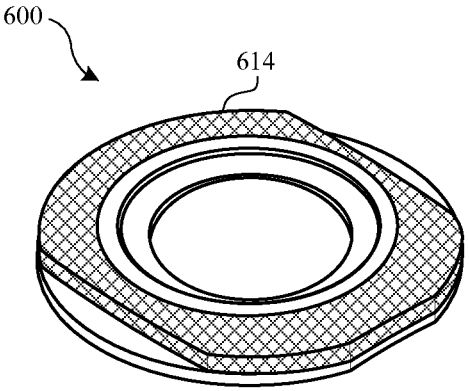
Figure 6C:
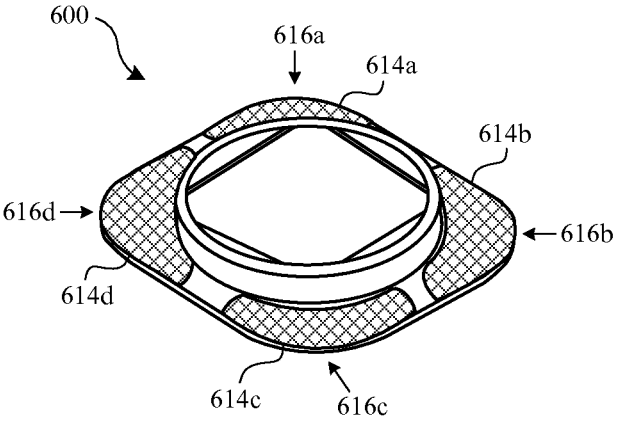

In embodiments involving an overmold, a number of manufacturing processes can be used in order to form a suitable noise dampening overmold. FIGS. 5A-5C and 6A-6C shows two different brackets formed using different overmolding processes. In particular, FIGS. 5A-5C show bracket 500 formed using an overmolding process without the use of a co-machining operation. FIGS. 6A-6C show bracket 600 formed using an overmolding process involving a co-machining process.

FIG. 5A shows bracket 500 after a pre-machining process is performed. During the pre-machining process engagements features 504*a*, 504*b*, 504*c* and 504*d* are formed at corners 502*a*, 502*b*, 502*c* and 502*d* of bracket 500. Bezel 512, which protrudes above surface 506 can be formed prior to or during the pre-machining process for forming engagements features 504*a*-504*d*. Engagements features 504*a*-504*d* can be recessed or protruding portions on surface 506 of trim 508 that are configured to accommodate and engage with portions of an overmold. In some embodiments, engagement holes 510 are additionally formed within surface 506 to also accommodate and engage with portions of an overmold. In some embodiments, engagement holes 510 are formed all the way through trim 508 and have undercut geometries. These embodiments will be described in detail below with reference to FIG. 7. Note that any suitable number of engagement features 504*a*-504*d* and engagement holes 510 can be used. In addition, the location and shapes of engagement features 504*a*-504*d* and engagement holes 510 can vary depending on design choice.

FIG. 5B shows bracket 500 after overmold 514 is molded onto bracket 500, including on surface 506 and bezel 512. In some embodiments, a perimeter of overmold 514 is offset with respect to a perimeter of trim 508 leaving a portion 516 of trim 508 exposed. This offset can be provided to assure that overmold 514 does not overhang over surface 506. At FIG. 5C, overmold 514 is cut to such that sections 514*a*, 514*b*, 514*c* and 514*d* positioned at corners 504*a*-504*d* remain. Overmold 514 can be cut using any suitable mechanism, including suitable CNC machining procedures.

FIGS. 6A-6C shows an alternative method for forming an overmold on bracket compared to as described above with reference to FIGS. 5A-5C. FIG. 6A shows bracket 600 after a pre-machining process where engagements features 604*a* and 604*b* are formed within surface 606 of trim 608. Bezel 610, which protrudes above surface 606 can be formed prior to or during the pre-machining process for forming engagements features 604*a* and 604*b*. Bracket 600 can be oversized compared to a final shape such that portions of bracket 600 can be removed during a subsequent co-machining process.

Engagement features 604*a* and 604*b* can be recessed or protruding portions on surface 606 of trim 608 that are configured to accommodate and engage with portions of an overmold. In some embodiments, engagement holes 602 are provided within surface 606 to accommodate and engage with portions of an overmold. In some embodiments, engagement holes 602 are formed all the way through trim 608 and have undercut geometries. The number, size and shapes of engagement features 604*a* and 604*b* and engagements holes 602 can vary depending on design requirements. Note that bracket 600 has a roughly round perimeter and does not yet have corners of a final shape. In some embodiments, flat portion 612 is formed as a reference for subsequent machining processes.

At FIG. 6B, overmold 612 is molded over at least a portion of surface 606. Overmold 612 can be oversized such that portions of overmold 612 can be removed during a subsequent co-machining process. Any suitable molding technique can be used, including an injection molding process. At FIG. 6C, bracket 600 and overmold 614 are co-machined forming corners 616*a*, 616*b*, 616*c* and 616*d* into bracket 600. In addition, overmold 614 is cut into sections 614*a*, 614*b*, 614*c* and 614*d* positioned at respective corners 616*a*-616*d*. Bracket 600 and overmold 614 can be shaped using any suitable mechanism, including suitable CNC machining procedures. Since bracket 600 and overmold 614 are co-machined, overmold 614 need not be offset with respect to trim 608, thereby achieving a tight tolerance. Thus, in some cases, the manufacturing methods described with reference to FIGS. 6A-6C may be preferred over the methods described with reference to FIGS. 5A-5C.

Figure 7:
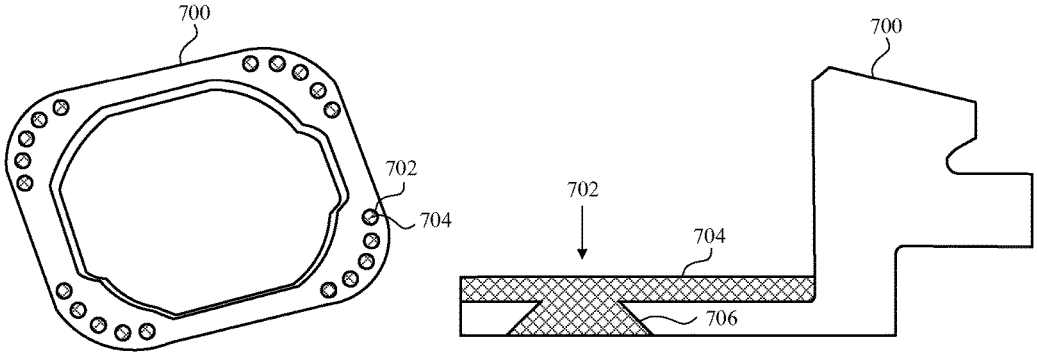
FIG. 7 shows perspective and section views of a bracket trim with interlocking features, in accordance with some embodiments.

As described above, in some embodiments, an overmold is formed within engagement holes formed within a trim of a bracket. To illustrate, FIG. 7 shows a perspective view and section view of bracket trim 700 showing engagement holes 702 formed therein. Overmold material 704 molds into and engages with the sidewalls 706 of holes 702, thereby securing overmold 704 to trim 700. In some embodiments, sidewalls 706 of engagement holes 702 have an undercut geometry to withstand forces separating overmold 704 from within engagement holes 702, thereby locking overmold 704 to trim 700. In this way, engagement holes 702 can be referred to as interlocking features.

Figure 8A:
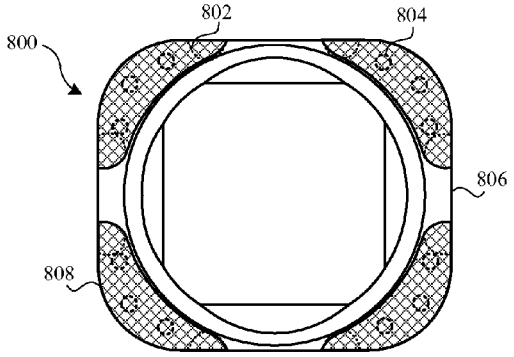
FIGS. 8A-8D show four different brackets having noise dampening overmolds formed thereon, in accordance with some embodiments.
Figure 8B:
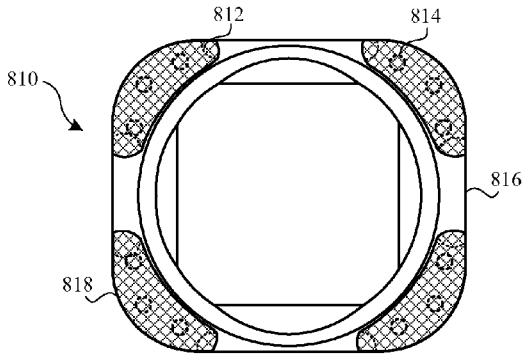

As described above, overmolds can have any number of sections and have any shape suitable for acting as a noise dampener. To illustrate, FIGS. 8A-8D show brackets having different patterns of noise dampening overmolds formed thereon in accordance with some embodiments. FIG. 8A shows bracket 800, which includes trim 806 with engagement features 802 and engagement holes 804. Overmold 808 is formed in four sections along corners of trim 806. Overmold 808 is secured to trim 806 by engagement features 802 and engagement holes 804. FIG. 8B shows bracket 810, which includes trim 816 with engagement features 812 and engagement holes 814. Overmold 818 is formed in four sections along corners of trim 816 and is secured to trim 816 by engagement features 802 and engagement holes 804. As shown, overmold 818 and engagement features 812 have different shapes and are in different locations compared to overmold 808 and engagement features 802 of bracket 800.

Figure 8C:
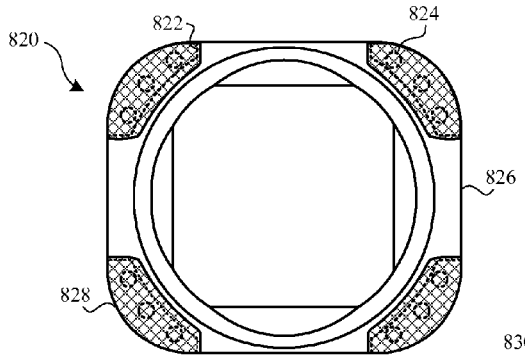
Figure 8D:
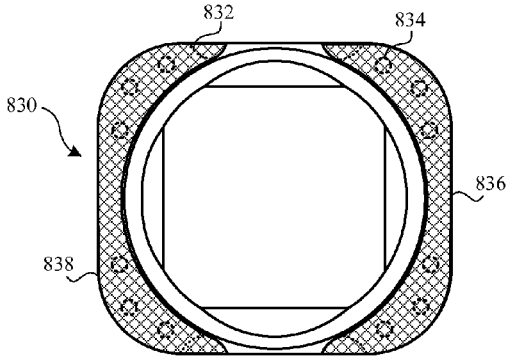

FIG. 8C shows bracket 820, which includes trim 826 with engagement features 822 and engagement holes 824. Overmold 828 is formed in four sections along corners of trim 826 and is secured to trim 826 by engagement features 822 and engagement holes 824. As shown, engagement features 822 have different shapes compared to the engagement features of brackets 800 and 810. FIG. 8D shows bracket 830, which includes trim 836 with engagement features 832 and engagement holes 834. Overmold 838 is formed in two sections along opposing sides of trim 836 and is secured to trim 836 by engagement features 832 and engagement holes 834. Note that the number and pattern of overmolds, engagement features, and engagement holes shown in FIGS. 8A-8D are illustrative of a few embodiments and are not meant to limit the scope of possible combinations and configurations.

Figure 9:
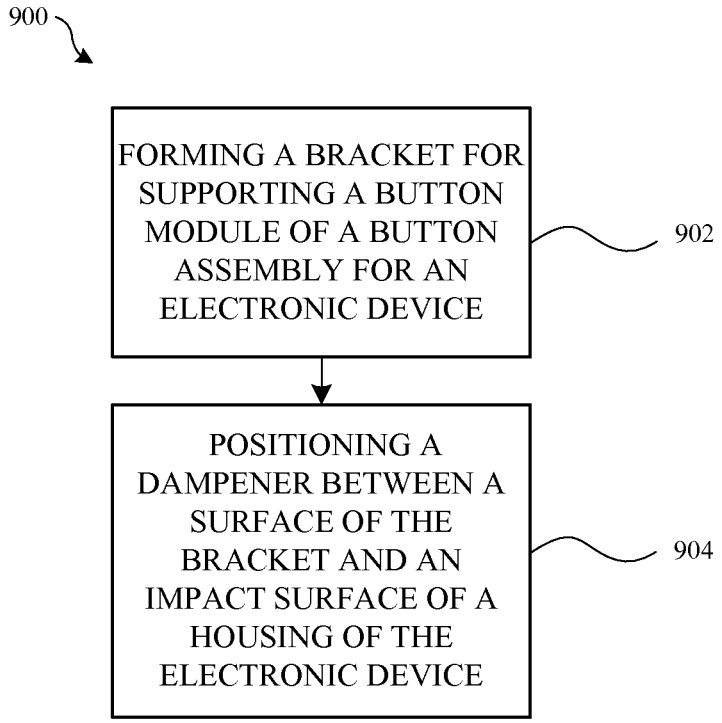
FIG. 9 shows a flowchart illustrating a process for forming a button assembly that includes a noise dampener, in accordance with some embodiments.

FIG. 9 shows flowchart 900 illustrating a process for forming a button assembly that includes a noise dampener, in accordance with described embodiments. At 902, a bracket for supporting a switch module of a button assembly for an electronic is formed. The bracket can be positioned within an opening of a housing for the electronic device. The bracket includes a trim with a surface that contacts the housing when a user of the electronic device presses the switch module. The bracket and housing can each be made of hard material such that when the trim contacts the housing an audible noise is created.

At 904, a dampener is positioned between the surface of the bracket and an impact surface of the housing. The dampener can be in the form a thin layer of material made of a sufficiently compliant material to reduce the audible noise. In some embodiments, the dampener is made of a plastic material. The dampener can be in the form of a coverlay that is adhered to the surface of the trim using an adhesive or can be in the form of an overmold that is molded onto the surface of the trim.

Figure 10A:
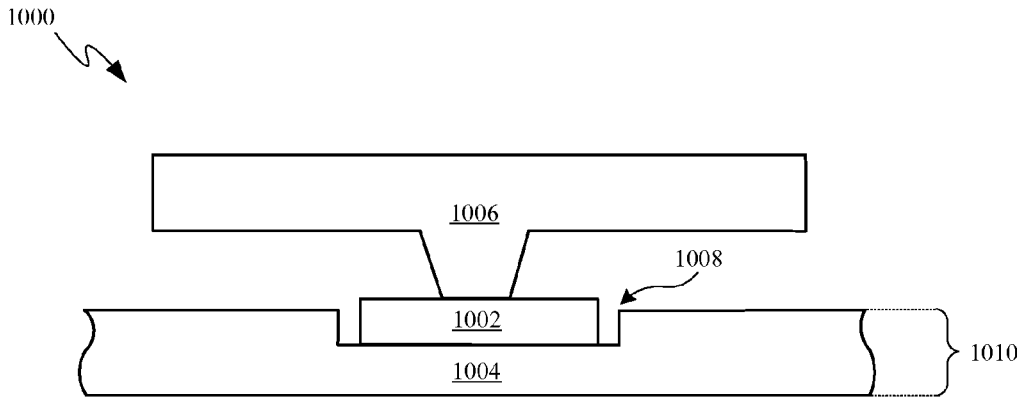
FIGS. 10A and 10B show a button assembly that includes a shim, in accordance with some embodiments.
Figure 10B:
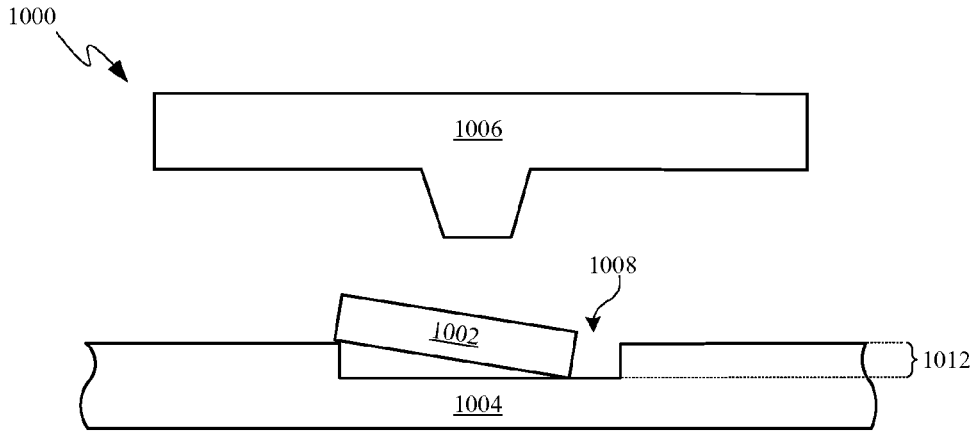

As described above, the button assemblies described herein can include one or more shims used to align various components of the button assemblies. FIGS. 10A and 10B show section views of a portion of button assembly 1000, which includes shim 1002 positioned between bracket 1004 and switch 1006. Switch 1006 is configured to provide an electrical connection button assembly 1000 and an electrical component of the electrical device that is associated with button assembly 1000. In particular, shim 1002 is positioned within recess 1008 if bracket 1004. The sidewalls of recess 1008 constrain shim 1002 with respect to bracket 1004 when button assembly 1000 is fully assembled. Bracket 1004 can be configured to support a switch module of button assembly 1000. In some embodiments, thickness 1010 of bracket 1004 is minimized so as to minimize a stack up thickness of button assembly 1000. Shim 1002 is generally a thin piece of material used to align or accommodate for dimensional tolerance differences between different components of a button assembly. In some cases, shim 1002 can reduce play of the button assembly and improve reliability of the button assembly. Shim 1002 of button assembly 1000 can be made of any suitable material having sufficient rigidity for retaining its general shape when a pressing force is applied to switch 1006. In some embodiments, shim 1002 is made of a metal material, such as stainless steel or hard aluminum alloys.

One problem associated with the configuration of button assembly 1000 is that although shim 1002 is positioned within recess 1008, the sidewalls of recess 1008 may not be enough to constrain shim 1002 with respect to bracket 1004 and shim 1002 can shift within recess. In some embodiments, an adhesive applied between bracket 1004 and shim 1002 to help stabilize shim 1002. Another disadvantage of the configuration of button assembly 1000 relates to assembly of button assembly 1000. To illustrate, FIG. 10B shows button assembly 1000 during an assembly operation, with shim 1002 being positioned within recess 1008 of bracket 1004. Since in some embodiments thickness 1010 of bracket 1004 is minimized, recess 1008 recesses a small distance 1012 within bracket 1004. In a particular embodiment distance 1012 is about 0.1 mm. Thus, during assembly, it may be difficult to detect when shim 1002 is positioned askew relative to recess 1008, as shown in FIG. 10B. If shim 1002 is not properly seated within recess 1008 during subsequent assembly procedures, this could have detrimental consequences including scrapping of the button assembly 1000.

Figure 11A:
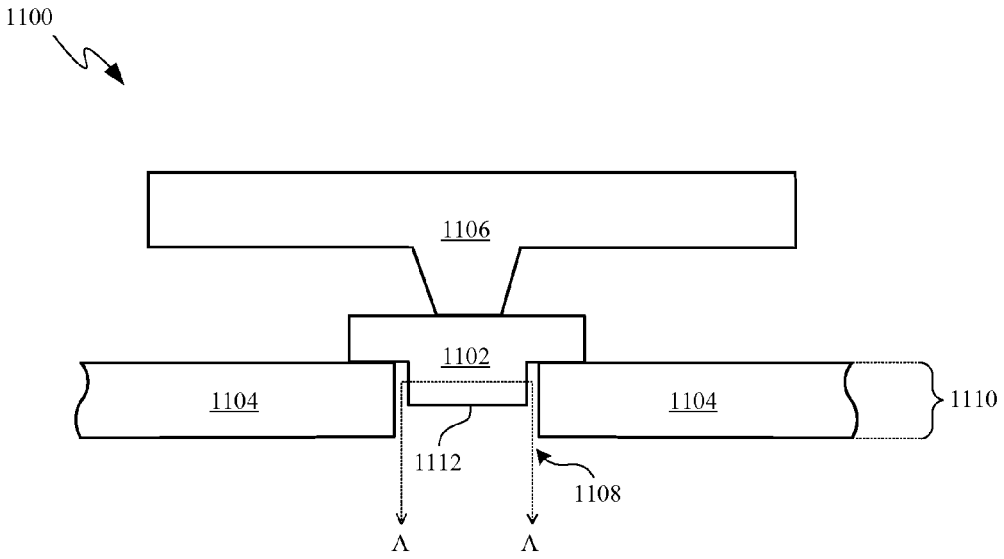
FIGS. 11A and 11B show a button assembly that includes a shim with an alignment feature, in accordance with some embodiments.
Figure 11B:
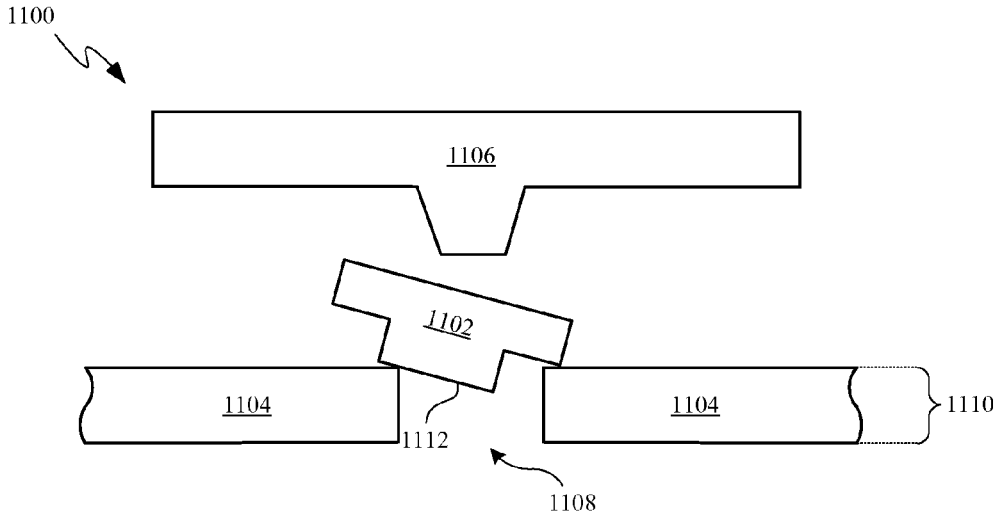

To address the limitation of a button assembly configuration described above with reference to FIGS. 10A and 10B, some embodiments include a shim that has an alignment feature. FIGS. 11A and 11B show button assembly 1100 that includes shim 1102 with an alignment feature 1112, in accordance with some embodiments. Shim 1102 is configured to be positioned between bracket 1104 and switch 1106. In some cases, shim 1102 can reduce play of the button assembly 1100 and improve reliability of the button assembly 1100. Switch 1106 is configured to provide an electrical connection button assembly 1100 and the electrical device that is associated with button assembly 1100. Bracket 1104 is configured to support switch 1106 with respect to a housing of the electronic device. Alignment feature 1112 corresponds to a protruding portion or pin that protrudes from a base of shim 1102 and is configured to fit within recess 1108 of bracket 1104. Since shim 1102 is positioned within recess 1108, this prevents shim 1102 from shifting during the manufacture and/or operation of button assembly 1100. In some embodiments, recess 1108 corresponds to a hole that is formed through the thickness 1110 of bracket 1104. Shim 1102 can be made using any suitable manufacturing process, including a turning process (similar to the way screws are made) or a forging process.

Since alignment feature 1112 constrains the position of shim 1102 with respect to bracket 1104, no sidewalls, or very small sidewall, are needed. This can reduce the thickness 1110 of bracket 1104 compared to thickness 1010 of bracket 1004 shown in FIGS. 10A and 10B. In addition, the configuration of button assembly 1100 can provide more reliable assembly compared to button assembly 1000. To illustrate, FIG. 11B shows button assembly 1100 during an assembly operation, with shim 1012 being positioned within recess 1108 of bracket 1104. When shim 1102 is positioned askew relative to recess 1108 and bracket 1104, as shown in FIG. 11B, shim 1102 will be positioned at a more extreme angle compared to shim 1002 of FIG. 10B. Thus, misalignment of shim 1102 will be more easily detected during the manufacturing process, reducing the potential of scraping of parts.

Figure 11C:
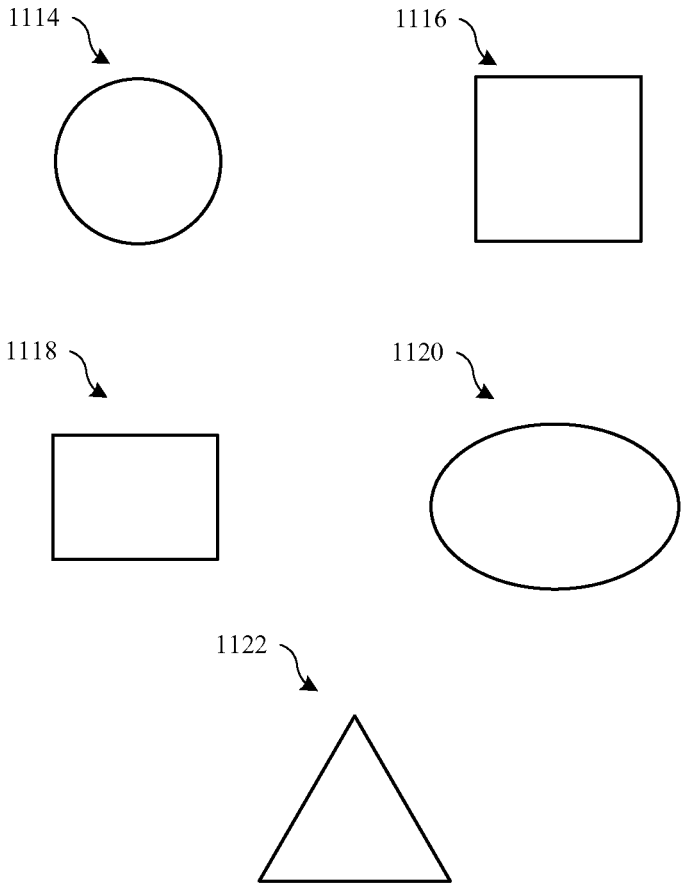
FIG. 11C show section views of alignment features of shims, in accordance with some embodiments.

FIG. 11C shows different possible shapes of alignment feature 1112 of shim 1102 as viewed from section line A-A. As shown, alignment feature 1112 can have any suitable shape, including a round 1114, square 1116, rectangular 1118, elliptical 1120, or triangular 1122 shape. The shape of recess 1108 would have a corresponding shape. For example, a shim 1112 having a round 1114 shape will have a correspondingly round shaped recess. In some embodiments it is preferable for alignment feature 1112 to have a round 1114 shape. This round 1114 shape can give shim 1102 a mushroom shaped appearance. The round 1114 shape can prevent interaction of shim 1102 with switch 1106 during operation that can damage switch 1106. The round 1114 shape can also allow easy location and fit of shim 1102 within recess 1108 since the orientation of shim 1102 would not matter. In other embodiments, shim 1102 has a square 1116, rectangular 1118, elliptical 1120, or triangular 1122 shape to assure the shim 1112 is positioned within recess 1108 at a predetermined orientation with respect to bracket 1104.

In some embodiments, the surface quality of shim 1102 is important. For example, in some cases it may be preferable for shim 1102 to have a very smooth surface where shim 1102 contacts bracket 1104 allowing for less frictional force between shim 1102 and bracket 1104. This can be achieved, for example, by buffing or plating surfaces of shim 1102 with a smooth coating. In a particular embodiment, an electrophoresis method is used to electrolytically deposit an electrophoretic coating on surfaces of shim 1102. The electrophoretic coating can be made of an electrophoretic paint or ink. In a particular embodiment, multiple shims 1102 are formed using a forging process such that the multiple shims 1102 are attached to a sheet of material. The sheet having the multiple shims 1102 then undergoes an electrophoresis process to coat the multiple shims 1102 at once. The individual shims 1102 can then be broken out into separated shims 1102 with the electrophoretic coatings intact. In other embodiments, it is preferable for shim 1102 to have a matt or blasted surface to provide good engagement with the bracket 1104. The different textures, i.e., smooth or matt, can provide different feels to the switching mechanism of button assembly 1100.

As described above, in some embodiments the shims are customized to accommodate varying tolerance stack ups of the components of button assemblies. Tolerance stack up refers to the cumulative effect of variations in dimensions of individual components of a button assembly that cause an overall variation in the button assembly compared to other button assemblies within a product line. A particular problem associated with button assemblies is that tolerance stack ups can cause each button assembly to have a different "feel". The feel of a button assembly can refer to, among other things, an amount of applied pressure necessary to cause activation of the button assembly, an amount of depression of the button assembly when pressed, and a return force of the button assembly after being pressed. Providing a shim that is customized for each button assembly can compensate for variations due tolerance stack up and provide a product line of button assemblies where each button assembly has substantially the same feel.

Figure 12A:
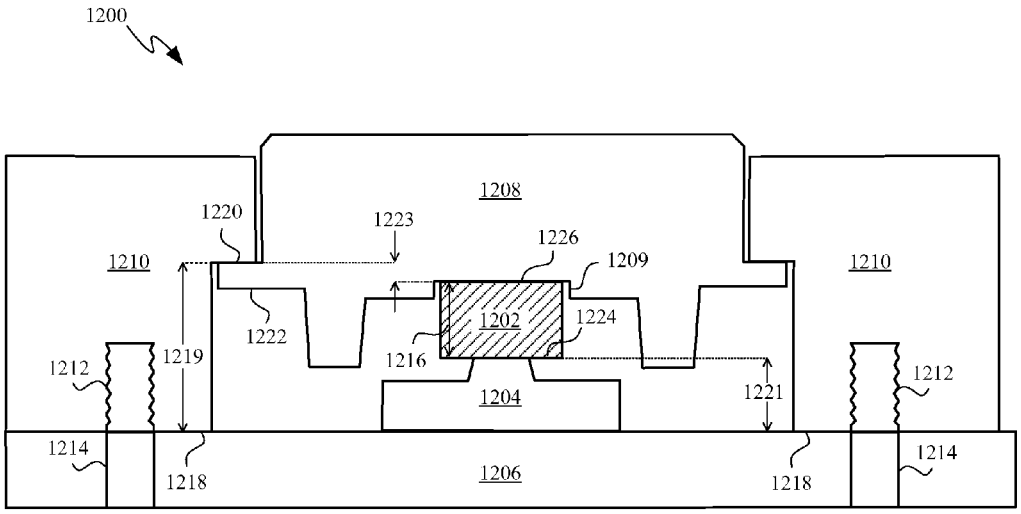
FIG. 12A shows a section view of a button assembly that includes customized shim, in accordance with some embodiments.

FIG. 12A shows a section view of a button assembly 1200 that includes a customized shim in accordance with some embodiments. Button assembly 1200 includes shim 1202, switch 1204, bracket 1206 and button 1208, which are positioned within housing 1210. Housing 1210 includes bore holes 1212 which align with holes 1214 of bracket 1206 to accommodate fasteners that fasten bracket 1206 to housing 1210. Housing 1210 also includes an indented region, which includes an opening for accommodating button 1208. Button 1208 corresponds to an exterior user interface of button assembly 1200 and is configured for a user to press. Switch 1204 is configured to provide an electrical connection between button assembly 1200 and an electrical component of the electrical device that is associated with button assembly 1200. For example, switch 1204 can control a volume or a power (on/off switch), or correspond to a menu or home button of the device. Shim 1202 is positioned between switch 1204 and button 1208 and within pocket 1209 of button 1208.

Switch 1204, bracket 1206, and button 1208 each have tolerances associated with them during the manufacturing process such that when assembled together could lead to an unacceptable amount of tolerance stack up. In a particular embodiment, the tolerances in switch 1204, bracket 1206, and button 1208 can lead to a combined stack up tolerance of about 0.2 mm. If shim 1202 is too thin, one or more of switch 1204, bracket 1206, button 1208, and shim 1202 can shift during operation of button assembly 1200 causing button assembly 1200 to have a loose feel and/or to malfunction. If shim 1202 is too thick, this can detrimentally affect the amount of preload for button assembly 1200, which can detrimentally affect the feel of button assembly 1200. In addition, different button assemblies will have varying amount of combined stack up tolerances, leading to inconsistent button assembly functionality.

To address this problem, shim 1202 is configured to accommodate varying thicknesses of one or more of switch 1204, bracket 1206, and button 1208. In particular, a customized thickness 1216 of shim 1202 is chosen to accommodate the stack up tolerance variations. Choosing thickness 1216 prevents shifting of one or more of switch 1204, bracket 1206, button 1208, and/or shim 1202 during operation of button assembly 1200. In addition, providing a shim 1202 that is customized for each button assembly 1200 will result in a product line of button assemblies 1200 that have a consistent feel and performance.

In order choose thickness 1216 of shim 1202, multiple measurements are taken with respect to datum surfaces of housing 1210, bracket 1206, switch 1204, and button 1208. According to some embodiments, three measurements are taken: first distance 1219, second distance 1221 and third distance 1223. In particular, a first distance 1219 between datum surface 1218 of bracket 1206 and first datum surface 1220 of button 1208 is measured. In some embodiments, first distance 1219 is determined by measuring a distance between a surface of housing 1210 that engages with button 1208 (corresponding to datum surface 1220) and a surface of housing 1210 that engages with bracket 1206 (corresponding to datum surface 1218). In one embodiment datum surface 1218 is defined by a surface on bracket proximate hole 1214, and first datum surface 1220 is defined by a surface of flange 1222 of button 1208. Flange 1222 can be configured to engage with housing 1210 when button assembly 1200 is fully assembled. A second distance 1221 between datum surface 1218 of bracket 1206 and datum surface 1224 of switch 1204 is measured. In one embodiment, datum surface 1224 is defined by a top surface of switch 1204. Second distance 1221 can correspond to a height of switch 1204. A third distance 1223 between first datum surface 1220 of button 1208 and second datum surface 1226 of button 1208 is measured. In one embodiment, second datum surface 1226 is defined by a surface within pocket 1209 of button 1208.

Once first distance 1219, second distance 1221, and third distance 1223 are measured, a customized thickness 1216 of shim 1202 can be calculated so as to be thick enough to provide an optimal amount of preload for button assembly 1200 yet thin enough to prevent shifting of one or more of switch 1204, bracket 1206, button 1208, and shim 1202. In one embodiment, thickness 1216 of shim 1202 can be calculated to provide a predetermined amount of preload force to provide a particular feel for button assembly 1200. In some embodiments, it is preferable to apply pressure on button assembly 1200 while the measurements are performed. For example, switch 1204 can have gaps related to air can get trapped inside the mechanism of switch 1204 when pressure is not applied.

Figure 12B:
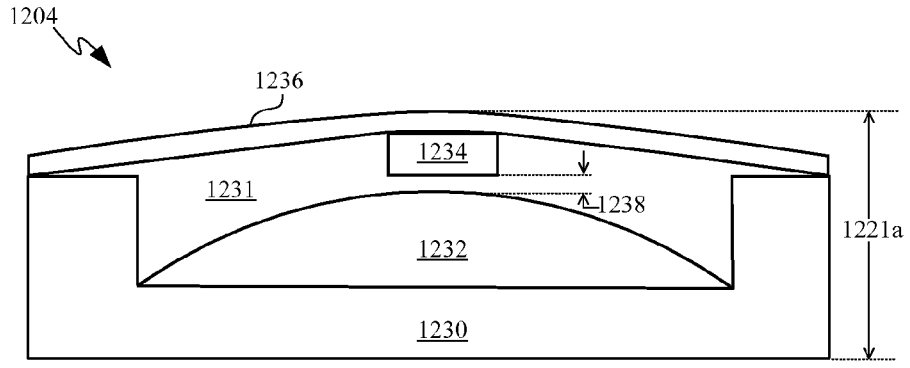
FIGS. 12B-12D show section views of a switch as part of the button assembly of FIG. 12A.
Figure 12C:
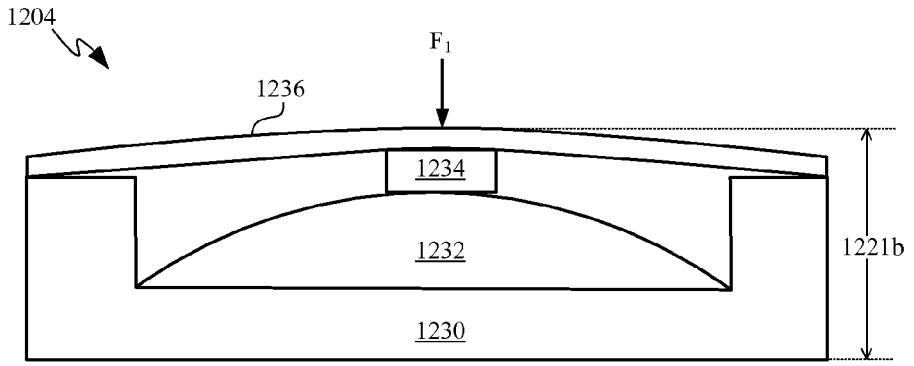
Figure 12D:
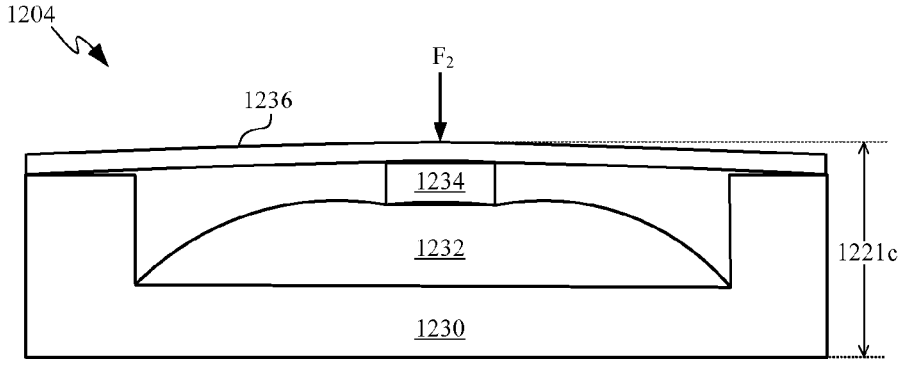

FIGS. 12B-12D show section views of switch 1204 before and after applying a preload force. In the embodiments shown in FIGS. 12B-12D, switch 1204 has a dome-type switch mechanism. Note that other types of switches with different mechanisms may also be used. Switch 1204 includes base 1230, dome 1232, nub 1234 and membrane 1236. Base 1230 can correspond to a rigid support that supports dome 1232. Dome 1232 can correspond to a flexible and resilient material or combination of materials. Nub 1234 can be a rigid body that adds height to switch 1234. Membrane 1236 can correspond to a flexible film or membrane that positions nub 1234 with respect to dome 1234. Membrane 1236 can seal internal regions of switch 1236 such that a sealed cavity 1231 is formed.

FIG. 12B shows switch 1204 without an applied preload force. As shown, gap 1238 can form between dome 1232 and nub 1234. Gap 1238 can be caused by air or other gas that gets trapped within cavity 1231 of switch 1204 during assembly. In some cases, gap is formed when the air or gas expands due to exposure of switch 1204 to a higher temperature than surroundings where switch 1204 was assembled. As a result of gap 1238, switch 1204 has a first height 1221*a*. At FIG. 12C, a first amount of preload force $F_1$ is applied to switch 1204, which reduces gap 1238. In FIG. 12C, first amount of preload force $F_1$ is sufficient to close gap 1238 such that nub 1234 contacts dome 1232. Applying first amount of preload force $F_1$ reduces the height of switch 1204 to a first reduced height 1221*b*. At FIG. 12D, a second amount of preload force $F_2$ is applied to switch 1204. Second amount of preload force $F_1$ is larger than preload force $F_1$ and not only closes gap 1238 but also compresses dome 1232 to a certain amount. Applying second amount of preload force $F_2$ further reduces the height of switch 1204 to a second reduced height 1221*c*. Note that once the first amount or the second amount of preload forces $F_1$ and $F_2$ are removed, dome 1232 can spring back into its original dome shape, thereby providing the backpressure for returning switch 1204 to its original position (e.g., FIG. 12B).

Thus, the amount of force applied to switch 1204 can result in switch 1204 having different heights. In addition, different amounts of preload force can be associated with giving a different feel of switch 1204 when assembled within button assembly 1200. In order to provide a consistent feel to the button assembly 1200, a predetermined amount of preload force can be applied prior to measurement. That is, the same amount of preload is applied to each switch 1204 to provide a consistent feel to the switch 1204 and to the button assembly 1200. For example, the predetermined amount of preload can correspond to $F_1$ or $F_2$, described above. In some embodiments, the amount of preload force is small, on the order of 5 to 10 grams. Thus, pressing on switch 1204 with a predefined small load (e.g., 5-10 grams) can provide more consistent measurement results. Any suitable mechanism can be used to apply the preload load, including applying a mass of predetermined weight, using an actuator to press onto switch 1204, or using a non-contact air blast to apply the pressure.

Figure 13:
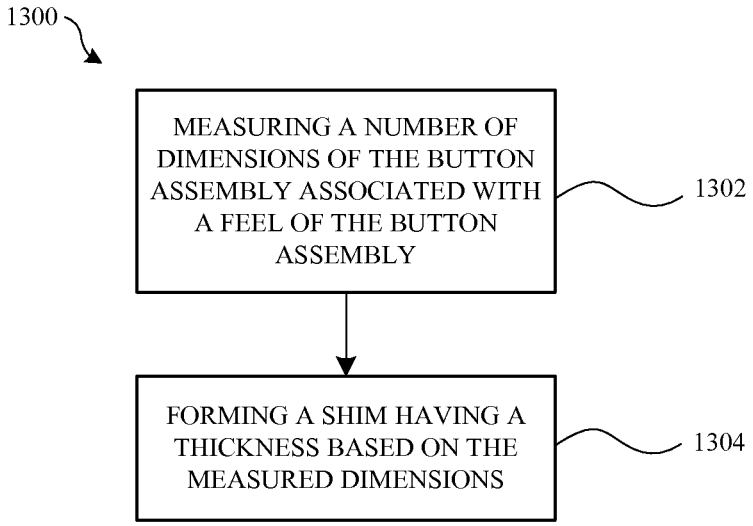
FIG. 13 shows a flowchart illustrating a process for forming a customized shim of a button assembly, in accordance with some embodiments.

FIG. 13 shows flowchart 1300 illustrating a high-level process for forming a customized shim of a button assembly, in accordance with some embodiments. At 1302, a number of dimensions of the button assembly associated with a feel of the button assembly are measured. As described above, dimensions of the button assembly associated with a feel of the button assembly can include a dimension of the switch while a predetermined preload force is applied to the switch. In some embodiments, the predetermined preload force can be associated with an amount of depression of button assembly when pressed, for example, by a user of the button assembly. In some embodiments, the predetermined preload force can be associated with an amount of applied pressure necessary to cause activation of the switch. In some embodiments, the predetermined preload force can be associated with a return force of the button assembly after being pressed. In some embodiments, the predetermined preload force is associated with two or more of the amount of depression, the amount of applied pressure necessary to cause switch activation, and the return force.

Other dimensions of the button assembly that can be measured include a dimension of an indented region of a housing for the electronic device. As described above, the indented region can be configured to accommodate the button assembly. Another dimension that can be measured includes one or more dimensions related to a pocket of the button assembly. As described above, the pocket can be configured to accommodate and position the shim with respect to the switch. At 1304, a customized shim having a thickness based on the measured dimensions is formed. As described above, using a customized shim for each button assembly can provide for a product line of button assemblies that have substantially the same feel when pressed by a user of the electronic devices.

Figure 14:
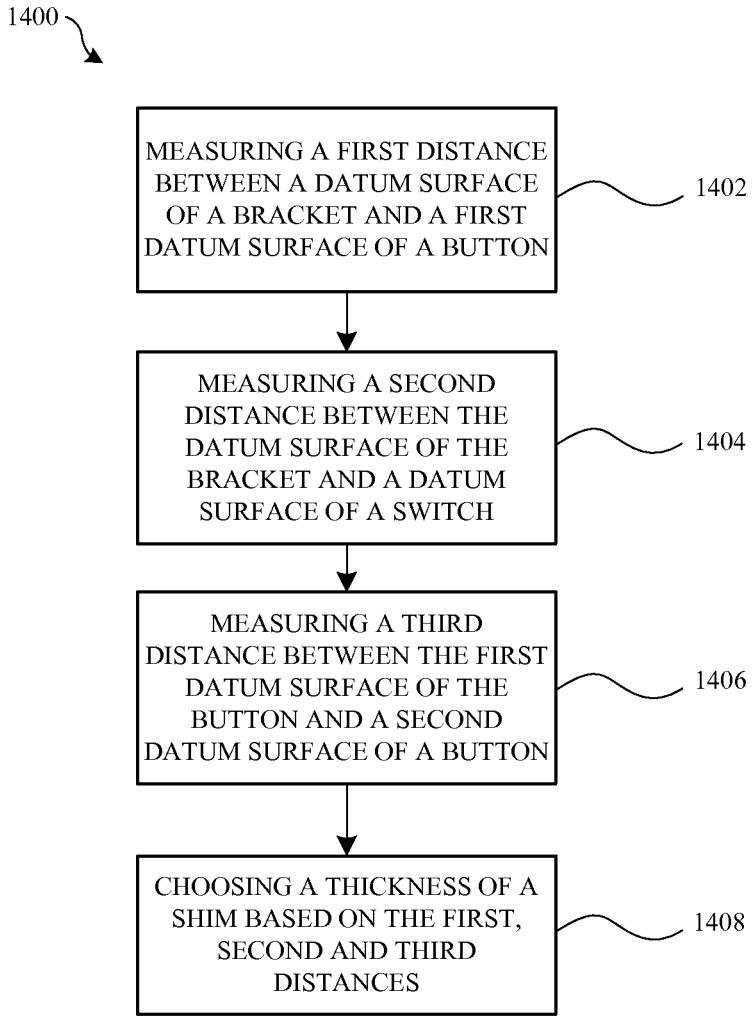
FIG. 14 shows a flowchart illustrating a process for forming a button assembly that includes a customized shim, in accordance with some embodiments.

FIG. 14 shows flowchart 1400 illustrating a process for forming a button assembly that includes a customized shim, in accordance with some embodiments. At 1402, a first distance between a datum surface of the bracket and a first datum surface of the button is measured. In some embodiments, the first distance is determined by measuring a distance between a two surfaces of an indented region of a housing where the button assembly is to be positioned. In one embodiment, the button includes a flange configured to engage with a housing of the electronic device and a surface of the flange defines the first datum surface of the button. At 1404, a second distance between the datum surface of the bracket and a datum surface of the switch is measured. At 1406, a third distance between the first datum surface of the button and a second datum surface of the button is measured. In one embodiment, the button includes a pocket configured to position the shim therein and a surface of the pocket defines the second datum surface of the button.

In some embodiments, the first, second, and third distances are measured using a computer measurement device, such as a computer that is coupled to a vision or imaging system that can detect surfaces and other visual markers. At 1408 a thickness of the shim is chosen based on the first distance, the second distance and the third distance. For example, a computer can calculate an optimal thickness for the shim so as to provide a predetermined amount of preload and minimum shifting of the button assembly. The shim can then be formed to have the chosen distance and positioned between the switch and the button during manufacture of the button assembly.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing and/or assembly operations or as computer readable code on a computer readable medium for controlling a manufacturing/assembly line. The computer readable storage medium is any data storage device that can store data, which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A button assembly for an electronic device having a housing with an opening, the button assembly comprising:

a switch module;

a bracket configured to support the switch module, the bracket positioned within the housing at the opening, the bracket including a trim and a through hole formed through the trim, the through hole having an undercut; and a dampener positioned on the trim such that actuation of the switch module causes the dampener to engage the housing and the trim is prevented from directly contacting the housing, wherein the dampener is disposed in the through hole such that the dampener interlocks with the bracket via the undercut.

2. The button assembly of claim 1, wherein the through hole comprises:

a first diameter at a first surface on which the dampener is positioned, and a second diameter at a second surface opposite the first surface, the second diameter greater than the first diameter.

3. The button assembly of claim 1, wherein the trim includes four sides, wherein the dampener has two sections with each section formed on opposing sides of the trim.

4. The button assembly of claim 1, wherein the trim includes four corners, wherein the dampener has four sections with each section formed proximate a corner of the trim.

5. The button assembly of claim 1, wherein the dampener is comprised of a material configured to reduce a noise associated with pressing the switch module.

6. The button assembly of claim 1, wherein the dampener is adhered onto a surface of the trim with an adhesive.

7. The button assembly of claim 1, wherein the dampener comprises a stiffening agent.

8. The button assembly of claim 7, wherein the stiffening agent comprises glass filler.

9. A button assembly for an electronic device, the button assembly comprising:

a button having a flange;

a switch configured to provide an electrical connection for the electronic device when actuated by the button;

a bracket that carries the switch at least partially in a housing of the electronic device; and a shim positioned on the bracket, the shim carrying the switch, wherein the shim includes a thickness that biases the flange against the housing, and wherein the shim prevents shifting of at least one of the bracket and the button during operation of the switch.

10. The button assembly of claim 9, wherein the shim has a round shape corresponding to a recess of the bracket.

11. The button assembly of claim 9, further comprising an alignment feature that has a shape such that the shim is maintained at least partially within a recess of the bracket at a predetermined orientation with respect to the bracket.

12. The button assembly of claim 9, wherein the shim has one of a square, rectangular, elliptical, or triangular shape.

13. The button assembly of claim 9, wherein a surface of the shim has an electrophoretic coating.

14. The button assembly of claim 9, wherein the shim includes a shape corresponding to a square, a rectangle, an oval, or a triangle.

15. The button assembly of claim 9, wherein the shim rests on the bracket.

16. The button assembly of claim 9, wherein the button comprises a pocket that at least partially receives the shim.

17. A method for assembling a button assembly for an electronic device, the method comprising:

securing a button in the electronic device, the button having a flange;

securing a switch in the electronic device, the switch configured to provide an electrical connection for the electronic device when actuated by the button;

providing a bracket that carries the switch at least partially in a housing of the electronic device; and positioning a shim on the bracket, the shim carrying the switch, wherein the shim includes a thickness that biases the flange against the housing, and wherein the shim prevents shifting of at least one of the bracket and the button during operation of the switch.

18. The method of claim 17, further comprising providing an alignment feature that has a shape such that the shim is maintained at least partially within a recess of the bracket and at a predetermined orientation with respect to the bracket.

19. The method of claim 17, wherein positioning the shim on the bracket comprises one of a square shim, a rectangular shim, an elliptical shim, or a triangular shim.

20. The method of claim 17, wherein the button comprises a pocket that at least partially receives the shim.

* * * * *